United States Patent [19]

Grace

[11] Patent Number: 4,972,999

[45] Date of Patent: Nov. 27, 1990

[54] ICE PIECE BARRIER FOR SELECTIVE ICE CRUSHER DISPENSER

[75] Inventor: James M. Grace, Elberon, Iowa

[73] Assignee: Amana Refrigeration, Inc., Amana, Iowa

[21] Appl. No.: 459,488

[22] Filed: Jan. 2, 1990

[51] Int. Cl.[5] ..... B02C 13/06

[52] U.S. Cl. ..... 241/30; 62/320; 241/101.1; 241/225; 241/243; 241/DIG. 17

[58] Field of Search ..... 62/320; 241/DIG. 17, 241/101 R, 101.1, 101.2, 101.4, 243, 222, 224, 225, 30, 65, 23

[56] References Cited

U.S. PATENT DOCUMENTS 3,602,441 8/1971 Alvarez .
3,889,888 6/1975 Prada ..... 241/DIG. 17 X
4,176,527 12/1979 Linstromberg et al. .

*Primary Examiner*—Mark Rosenbaum

*Attorney, Agent, or Firm*—William R. Clark; Richard M. Sharkansky

[57] ABSTRACT

An ice barrier for a selective ice cube and crushed ice dispenser having a crusher section including a crusher arm mounted to a horizontal shaft axially rotatable in either direction, and a stationary crusher arm mounted to one side of the shaft. When the shaft is driven in one direction, ice pieces fed to the crusher section are caught and crushed between the rotating and stationary crusher arms. However, when the shaft is driven in the opposite direction, ice pieces escape down the side of the shaft opposite the stationary crusher arm thereby avoiding being crushed. The ice barrier is frictionally coupled for rotation with the shaft between a first position in the whole ice piece path and a second position out of the path. Accordingly, the ice barrier blocks the whole ice piece path when the crusher is operated in the ice crushing mode.

16 Claims, 6 Drawing Sheets

ICE PIECE BARRIER FOR SELECTIVE ICE CRUSHER DISPENSER

BACKGROUND OF THE INVENTION

The field of the invention generally relates to a selective ice dispenser optionally capable of dispensing either whole ice pieces or crushed ice, and more particularly relates to apparatus and method for preventing whole ice pieces from being dispensed in the ice crushing mode of operation.

Selective ice crushers that can optionally dispense either crushed ice or whole ice cubes have been used in conventional household refrigerators for many years, and commonly are located in the freezer sections of side-by-side refrigerators. Two such selective ice dispensers are described in U.S. Pat. Nos. 3,602,441 issued Aug. 31, 1971 and 4,176,527 issued Dec. 4, 1979.

In a recent selective ice dispenser, a reversible motor is provided for driving a shaft, and the axial direction of rotation of the shaft determines whether crushed ice or whole ice cubes or pieces are dispensed. More specifically, a set of crusher blades are center mounted on the shaft for rotation therewith inside an ice crusher chamber, and a set of stationary interleaved crusher blades are positioned on one side of the shaft. When the shaft mounted blades are rotated up and over towards the stationary blades, ice pieces falling on the stationary blade side of the shaft land on the stationary blades, and ice pieces falling on the opposite side of the shaft are carried up and over the shaft by the rotating crusher blades. In either case, the ice cubes are held by the stationary crusher blades and then crushed when the next set of rotating crusher blades comes down on them. When the shaft mounted blades are rotated in the opposite direction, ice pieces on the stationary crusher blade side of the shaft are carried up and over the shaft to the opposite side by the smooth sides of the rotating crusher blades; the carried ice pieces and those ice pieces falling on the opposite side are not caught between the rotating and stationary crusher blades, and therefore they are dispensed intact as whole ice cubes. One problem with such arrangement is that occasionally a whole ice cube can be dispensed in the ice crushing mode. This happens because a cube falls down on the side of the shaft opposite the stationary crusher blades and the bottoms of the rotating crusher blades are not advanced past the vertical orientation far enough so as to catch it and carry it over the top. Accordingly, the ice cube falls straight through and comes out the chute with crushed ice.

SUMMARY OF THE INVENTION

There is provided a selective ice crusher that is fed whole ice pieces and optionally dispenses either crushed ice or whole ice pieces wherein the ice crusher comprises a horizontal shaft and means for axially rotating the shaft in either direction. The crusher further comprises a first stationary ice crusher arm mounted on one side of the shaft and a second crusher arm mounted to the shaft for rotation with the shaft wherein, when the shaft and the second crusher arm are rotated in one direction, ice pieces fed to the ice crusher are caught and crushed between the first and second crusher arms, and when the shaft and the second crusher arm are rotated in the opposite direction, ice pieces fed to the ice crusher fall down a path on the side of the shaft opposite the stationary crusher arm for delivery as whole ice pieces. In accordance with the invention, there is provided means rotatable with the shaft to a first position in the path when the shaft is rotated in the one direction for preventing whole ice pieces from falling down the path during the ice crushing mode. The preventing means is rotatable with the shaft to a second position out of the path when the shaft is rotated in the opposite direction so that the ice pieces are free to fall down the path in that mode of operation. It is preferable that the preventing means comprises a plate having a hole through which the shaft extends, and further comprises a friction clutch means for driving the plate in both direction and for allowing the plate to stop respectively at the first and second positions while the shaft continues to rotate in the respective directions. The friction clutch means may comprise a friction washer positioned on the shaft between the plate and the second crusher arm, and a friction washer may also be positioned on the other side of the plate. In order to provide the proper clutch pressure so as to obtain the desired friction, the friction washers are preferably waved plastic washers, and the axial space may be precisely determined by mounting them on a stepped washer inserted on the shaft. The preventing means preferably also comprises an axial flap and an axial hood wherein rotation of the preventing means is stopped in one direction by the hood engaging a stop on the stationary crusher arm, and in the opposite direction by the flap engaging the stationary crusher arm.

The invention may also be practiced by the method of preventing whole ice cubes or pieces from being dispensed during an ice crushing mode of operation of a selective ice crusher having a reversible motor driven shaft with a rotatable crusher arm connected thereto and a stationary crusher arm on one side of the shaft wherein, in the ice crushing mode, ice pieces are crushed between the rotatable crusher arm and the stationary crusher arm and in the whole ice piece mode, ice pieces are dispensed down a path on the side of the shaft opposite the stationary crusher arm, comprising the steps of rotating an ice barrier frictionally mounted to the shaft to a first position in the path in response to the shaft rotating in the one direction, and rotating the ice barrier to a second position out of the path in response to the shaft rotating in the opposite direction.

With such arrangement, whole ice pieces are prevented from being dispensed during the ice crushing mode of operation. An ice barrier is frictionally rotatable on the shaft between a first and second position in response to the direction of rotation of the shaft which determines the mode of operation. That is, when the shaft is rotated in the clockwise direction as it would be in the ice crushing mode, the ice barrier rotates to the first position in the normal whole ice piece path so that no whole ice pieces can slip through during that mode of operation. However, when the shaft is driven in the counterclockwise direction as it would be in the whole ice piece dispensing mode, the ice barrier is rotated to the second position which leaves the whole ice piece path unencumbered.

BRIEF DESCRIPTION OF THE DRAWINGS

The foregoing objects and advantages will be more fully understood by reading the description of the preferred embodiment with referenced to the drawings wherein.

DESCRIPTION OF THE PREFERRED EMBODIMENTS

Figure 1:
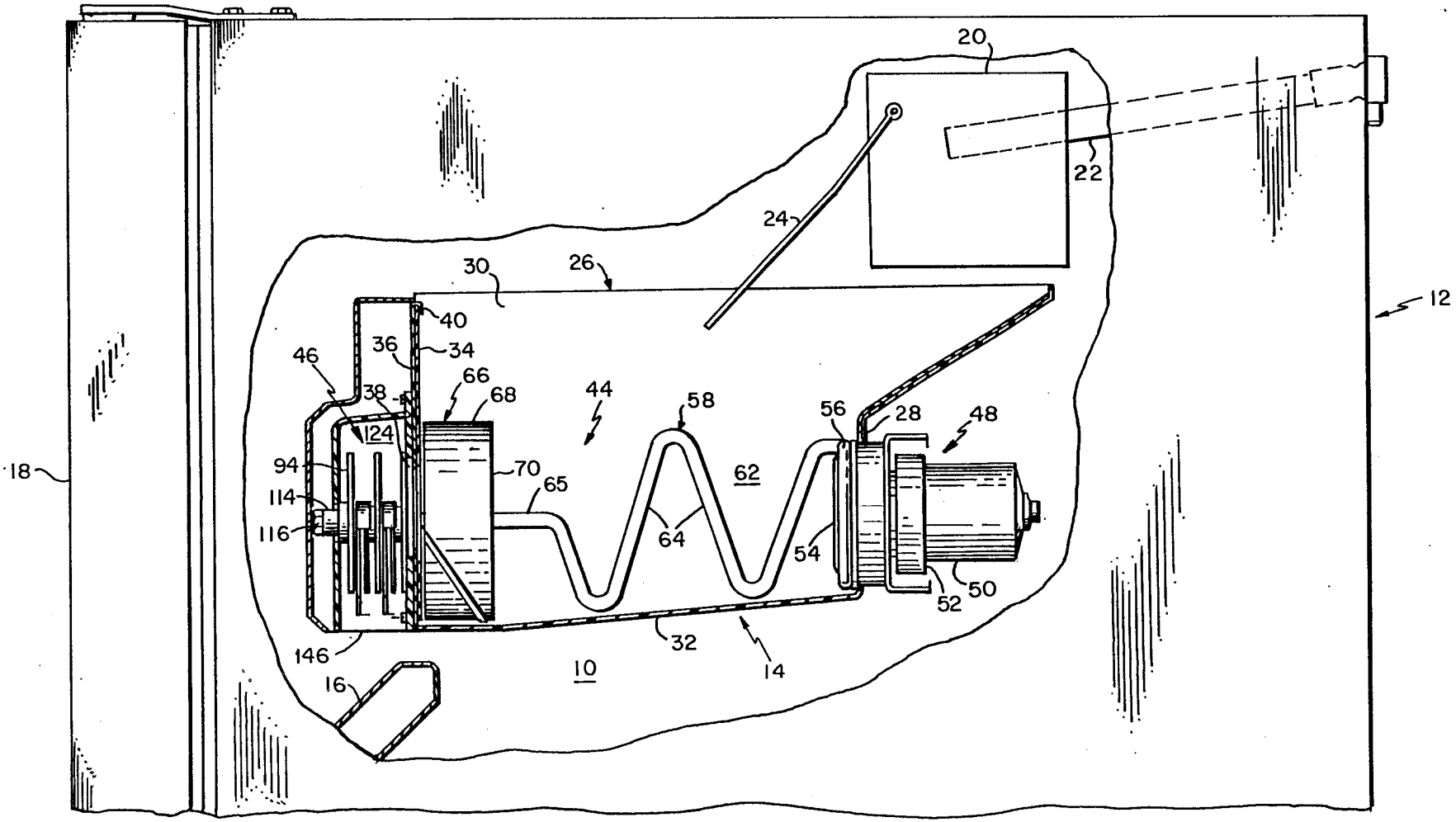
FIG. 1 is a partially broken away sectioned view of a refrigerator freezer compartment including an ice dispenser.

Referring to the drawings wherein like reference numerals depict like parts throughout the several views, FIG. 1 shows a portion of a freezer compartment 10 of a conventional refrigerator 12 such as a so-called side-by-side model. Ice dispenser 14 can selectively deliver hole ice cubes or crushed ice down a chute 16 to a conventional ice dispenser delivery area (not shown) in freezer door 18 without opening door 18. Within the upper portion of freezer compartment 10 is mounted an automatic ice maker 20 which may be of the well-known type presently provided in household refrigerators for the automatic production of ice pieces, generally referred to as ice cubes regardless of their particular shapes. As is well-known, water is supplied to ice maker 20 through tube 22 and, in response to sensor arm 24 indicating that plastic receptacle 26 or bucket is less than full of ice, ice maker 20 automatically, in conventional manner, harvests a load of ice pieces dropping them into receptacle 26, and then automatically refills with water to start the next cycle. When sensor arm 24 indicates that the receptacle is full of ice pieces, the automatic harvesting of ice is interrupted until such time as ice pieces are removed from receptacle 26. As is well known, freezer compartment 10 is maintained at a sub-zero temperature so that the ice pieces are stored in receptacle 26 until needed by the user.

Figure 2:
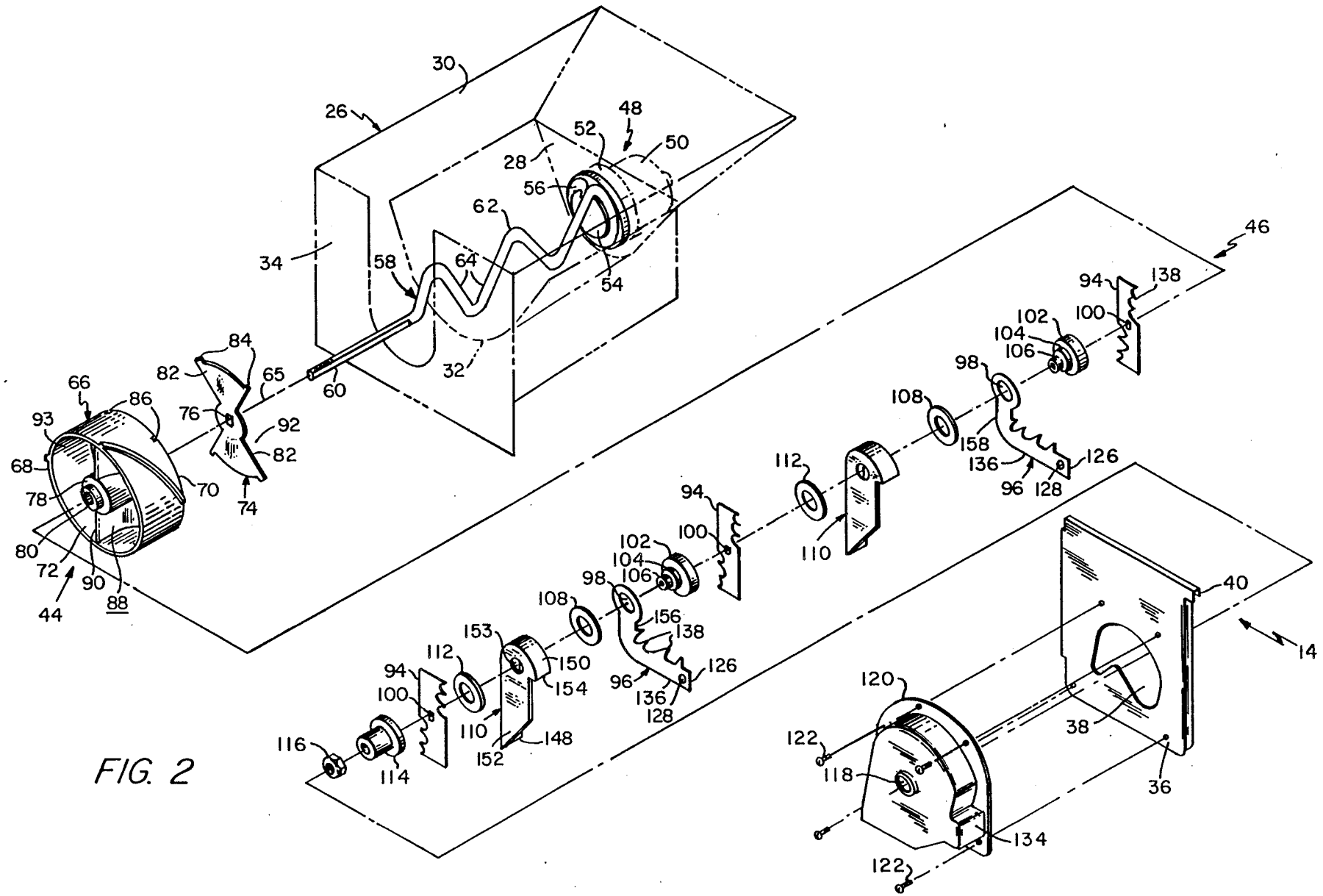
FIG. 2 is an exploded view of the ice dispenser.

With reference also to FIG. 2, receptacle 26, that is removably supported within freezer compartment 10, has a back wall 28, side walls 30, and a bottom wall 32 that is downwardly sloped for its entire length towards a front wall 34 that has a front plate 36 with ice discharge opening 38. Bottom wall 32 may preferably also be arcuate from side to side. Metal front plate 36 has a lip 40 that fits over the top of front wall 34. Alternatively, front plate 36 could be integrally formed as part of front wall 34.

Ice dispenser 14 generally includes an ice feed section 44 and a selective ice crusher section 46, both of which are responsive or activated by drive section 48. Drive section 48 includes a conventional reversible electric motor 50 and a speed reducing transmission 52 that is suitably coupled to a drive yoke 54 that engages a bent portion 56 of shaft 58. Thus, as shown, reversible motor 50 can cause shaft 58 to rotate axially in either direction. That is, depending on the drive direction of motor 50 as selected by the user, shaft 58 rotates in either the clockwise or counterclockwise direction. Here, for purposes of explanation only, the convention of clockwise and counterclockwise is with respect to a front view. As will be described later herein, feed section 44 feeds ice through discharge opening 38 regardless of the direction of rotation of shaft 58 but crusher section 46 only crushes the discharged ice pieces when the shaft is driven in the clockwise direction. Therefore, suitable operator actuable polarity reversing apparatus (not shown) is provided to drive reversible motor 50 in the clockwise direction when crushed ice is desired and to drive reversible motor 50 in the counterclockwise direction when whole ice pieces are desired. Typically, reversible motor 50 may have a starting torque of 106 inch/lbs, and the output of transmission 52 may be driven at 21 revolutions per minute.

Metal shaft 58 extends horizontally the entire length of receptacle 26 and has an extension portion 60 that extends forwardly through discharge opening 38, with the crusher section 46 being attached to the extension portion 60. An agitator portion 62 of shaft 58 or wire immediately in front yoke 54 is bent into a planar serpentine shape. That is, there are a number of segments 64 that deviate in some manner from the general axis 65 of shaft 58 so that when shaft 58 is rotated, segments 64 of agitator portion 62 agitate the ice. It is noted that segments 64 do not define a helically coiled wire auger because shaft 58 must help convey ice pieces to lift wheel 66 regardless of the direction of rotation. Accordingly, agitator portion 62 merely functions to agitate, rather than auger drive, the ice pieces so that they gravity feed down the sloped bottom wall 32 towards lift wheel 66.

Figure 3:
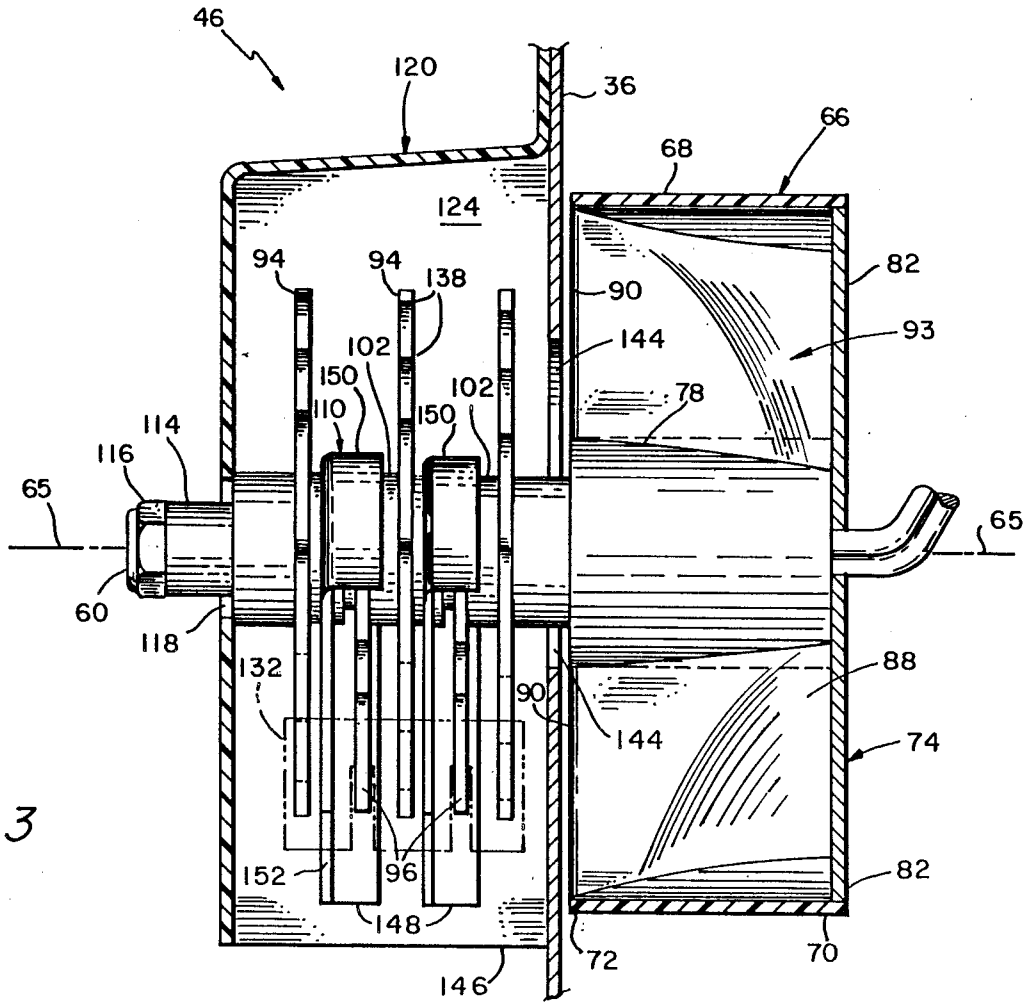
FIG. 3 is an expanded side sectioned view of the collar and the crusher section of the ice dispenser.

Also referring to FIG. 3, feed section 44 further includes a plastic molded lift wheel 66 or feed wheel that has an open ended collar 68 or sleeve having an inlet end 70 that receives ice pieces and an outlet end 72 that discharges or dispenses the ice pieces through discharge opening 38 in a metered fashion that is substantially independent of the ice piece fill level in receptacle 26. In fabrication and as shown in FIG. 2, a stainless steel ice breaker plate 74 having a keyed aperture 76 such as a double-D slot is first slid onto a corresponding shaped section of shaft 58 within receptacle 26. Lift wheel 66 has an axle 78 with a circular aperture 80, and it is next slid onto shaft 58 and is also positioned within receptacle 26 behind front plate 36. Ice breaker plate 74 has radial sectors 82 with peripheral fingers 84 that engage notches 86 in lift wheel 66 so as to impart the rotational torque of ice breaker plate 74 as driven by shaft 50 to lift wheel 66. Lift wheel 66 has a vane 88 that forms a narrow rib 90 extending from the axle across the internal diameter of the collar at the outlet end 72, and fans outwardly towards the inlet end 70 so as to substantially conform to the radial sectors 82 of the ice breaker plate 74. Thus, ice breaker plate 74 protects the scoop portion of the plastic vane 88 of the lift wheel 66 so that it doesn't chip or break when subjected to high torque forces that may be required to break up ice pieces as they enter the inlet 70 of lift wheel 66. The cut-out portions 92 of ice breaker plate 74 generally correspond or conform to the inlet or opening of vane 88 into collar 68, and vane 88 tapers downwardly forming a concave surface in the direction of outlet end 72. As a result, a rotationally symmetrical vane is provided that drives ice pieces from the inlet end 70 to the outlet end 72 regardless of the direction of rotation of lift wheel 66. Ice pieces that enter the openings of the vanes 88 at the inlet end 70 of lift wheel 66 are lifted upwardly as lift wheel 66 rotates, and then the ice pieces tumble or slide rearwardly down the vane 88, or are pushed rearwardly by the entry of new ice pieces into the lift wheel 66. At the outlet end, the ice pieces are dispensed or discharged through discharge opening 38 into crusher section 46. It has been known found that 3, 4, or 5 ice pieces may be simultaneously present in each side or conduit 93 of the lift wheel 66, and that sometimes an ice piece may make more than one revolution in the lift wheel 66 before being discharged. Because lift wheel 66 is angularly symmetrical in either direction so that it is operative when rotated either clockwise or counter clockwise, lift wheel 66 is not as efficient in driving ice pieces as some prior art lift wheels that could, for example, utilize a double bladed auger. However, lift wheel particularly relies on the force of incoming ice pieces to aid in the forward feeding, and the discharge opening 38 has been appropriately sized and shaped so that ice pieces feed on both the left and right side of shaft 58 regardless of the direction of rotation. As a result, lift wheel 66 has been found to meter an optimum feeding of ice pieces through discharge opening 38. For example, lift wheel 66 may typically rotate at 21 revolutions per minute, and dispense from 2–4 ice pieces per revolution. Typically, lift wheel 66 may have an internal diameter of 4.5 inches and an axial length of 1.75 inches.

Still referring to FIG. 2, crusher section 46 includes a set, here three, of spaced crusher arms 94 or blades rotatably secured to shaft 58, and a set, here two, of interspaced stationary crusher arms 96 or blades inserted onto shaft 58 but having circular apertures 98 such that stationary crusher arms 96 do not rotate with a shaft 58.

Figure 4C:
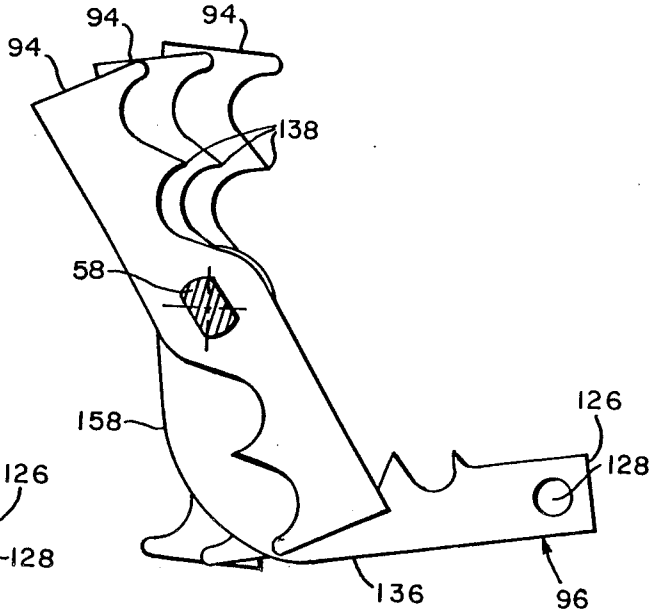
FIGS. 4A–C show sectioned views of the ice dispenser shaft at various locations in the ice crusher section.
Figure 4B:
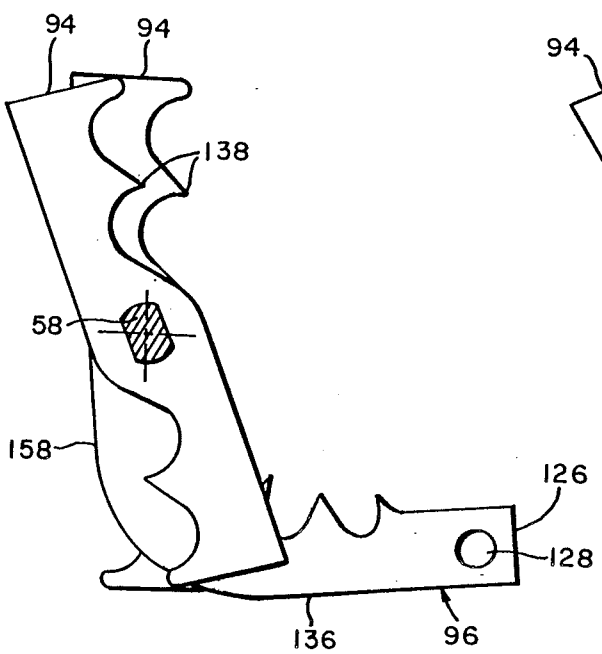
Figure 4A:
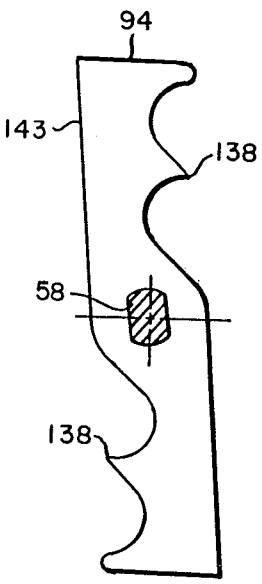

Referring also to FIGS. 4A-C, rotatable crusher arms 94 are suitably keyed to rotate with shaft 58 such as, for example, using a double-D shaft 58 with corresponding key holes 100 in rotatable crusher arms 94. As shown in FIG. 3, rotatable crusher arms 94 are spaced along shaft 58 such as, for example, $\frac{5}{8}''$ apart. In order to angularly stagger the rotatable crusher arms 94 by a few degrees, the double-D of extension portion 60 of shaft 58 is twisted along its length. More specifically, prior art crusher arms have been staggered so as to concentrate the crushing force and thereby reduce the required torque, but prior art apparatus used different angular orientations for the key holes on the respective crusher arms. Such apparatus required different crusher arms for the respective crusher arm mounting locations along the shaft, and also required due care in assembling the crusher section so that they were inserted on the shaft in the proper sequence. Here, however, the same rotatable crusher arm 94 is used for all three crusher arm locations, and the precise relative angular displacement is provided by twisting shaft 58. For example, FIG. 4A is a view showing the first rotatable crusher arm 94 nearest front plate 36 inserted on sectioned shaft 58. As noted, the double-D shaft is vertically oriented. After inserting intermediate parts to be described subsequently on shaft 58, FIG. 4B shows a view of a second identical rotatable crusher arm 94 inserted on shaft 58, and the shaft 58 is sectioned approximately $\frac{5}{8}''$ to the front of FIG. 4A. As can be seen, the shaft 58 has twisted by a small number of degrees, such as, for example, 10°, and the second rotatable crusher arm 94 is therefore oriented approximately 10° counterclockwise from the first rotatable crusher arm 94. Likewise, FIG. 4C shows the third identical rotatable crusher arm 94 inserted on shaft 58, and it has an angular displacement of approximately 20° from the first rotatable crusher arm 94 because the double-D shaft 58 is further twisted approximately $1\frac{1}{4}''$ to the front of the first rotatable crusher arm 94. Accordingly, the same rotatable crusher arm 94 can be stocked for all three locations in the crusher section 46, and the assembly is simplified because there is no special order or sequence for inserting the rotatable crusher arms 94. The staggering is precisely and accurately accounted for by the stamping of the shaft 58.

Referring again to FIGS. 2 and 3, a stepped washer 102 having a larger collar 104 and a smaller collar 106 facing away from the first rotatable crusher blade 94 is inserted onto the extension portion 60 of shaft 58 after the first rotatable crusher arm 94. Then, the circular aperture 98 of a stationary crusher arm 96 is inserted over the larger collar 104. Next, a waved friction washer 108 followed by barrier arm 110 and another waved friction washer 112 are inserted over smaller collar 106. Then, the same sequence of rotatable crusher arm 94, stepped washer 102, stationary crusher arm 96, friction washer 108, barrier arm 110, and friction washer 112 followed by another rotatable crusher arm 94 are inserted on the extension portion 60 of shaft 58. Finally, a bearing washer 114 and a holding bolt 116 are applied. The bearing washer 114 inserts through a bearing aperture 118 in a plastic molded housing 120 or cover that attaches by screws 122 to the front wall 34 of receptacle 26, and defines the ice crusher chamber 124.

Figure 5A:
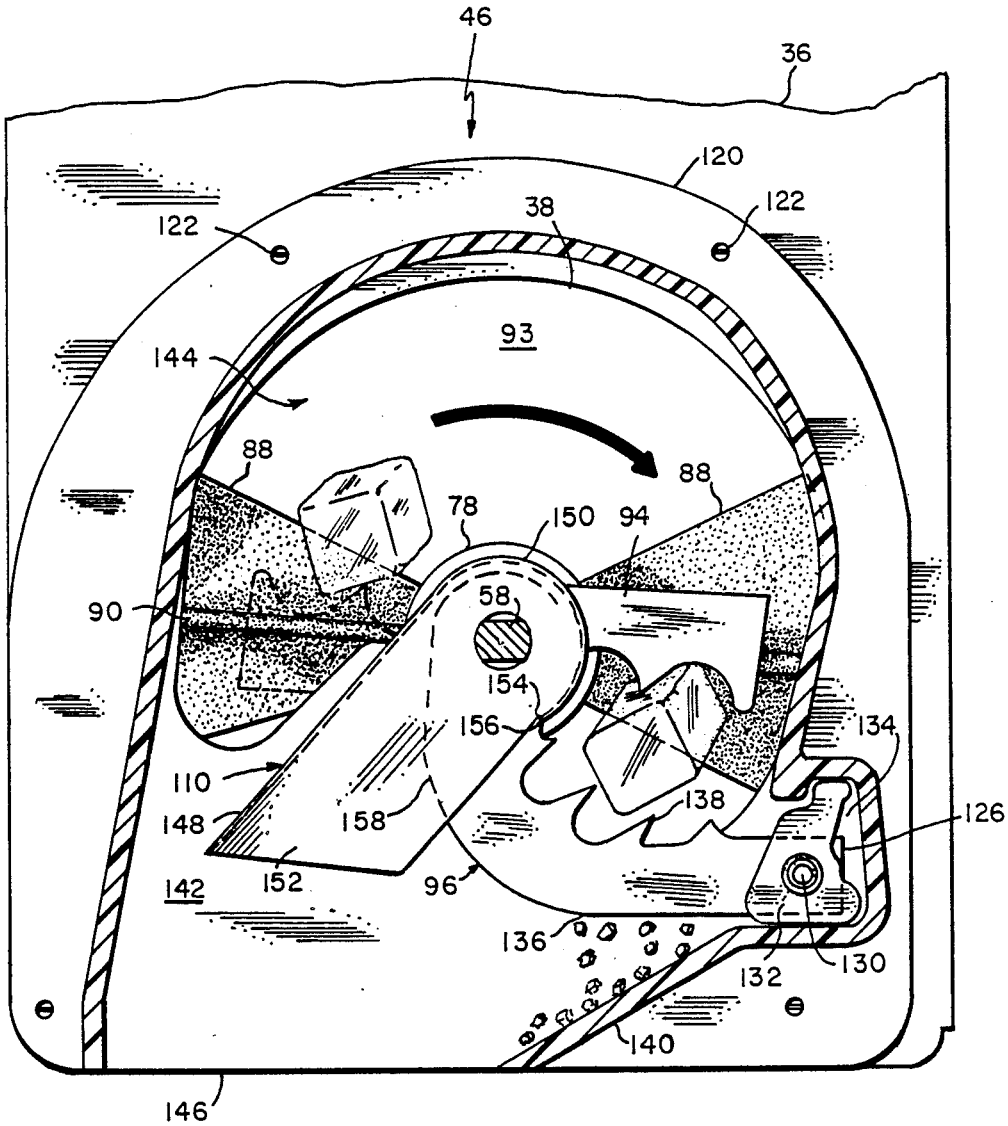
FIGS. 5A and 5B depict the ice crusher section with the rotatable blades being driven in the clockwise and counter clockwise directions, respectively.

As shown best in FIG. 5A, the distal ends 126 of stationary crusher arms 96 have holes 128 through which a bar 130 is inserted securing them to anchor 132 that seats into recess 134 or boot of housing 120 so as to prevent stationary crusher arm 96 from rotating with shaft 58.

The operation of dispenser 14 is described with reference to FIGS. 5A and 5B. As described heretofore, and also with reference to FIGS. 1 and 2, agitator portion 62 agitates ice pieces in receptacle 26 so as to cause them to convey or gravity feed down declined bottom wall 32 toward lift wheel 66 regardless of the direction of rotation of shaft 58 by reversible motor 50. Also, regardless of the direction of rotation of lift wheel 66, ice pieces are dispensed in a somewhat metered flow through discharge opening 38 into crusher section 46. Therefore, whether shaft 58 is rotated clockwise or counterclockwise as identified for convention only with respect to FIGS. 5A and 5B, ice pieces are fed through discharge opening 38 into crusher chamber 124, and they are fed through discharge opening 38 on both the left and right sides of shaft 58 regardless of the direction of rotation. When the user has selected crushed ice, reversible motor 50 drives shaft 58 in the clockwise direction as depicted in FIG. 5A which, for simplicity of illustration, is sectioned so as to show only the first rotatable crusher arm 94 and one stationary crusher arm 96 closest to discharge opening 38. In this ice crushing mode of operation, ice pieces that are fed through the right side of discharge opening 38 fall down onto the horizontal portion 136 of the stationary crusher arm 96 and ice pieces fed through the left side of discharge opening 38 are carried up and over shaft 58 by the next set of rotatable crusher arms 94, such that, in either case, the ice pieces end up on the right side where they are caught and crushed between the respective sets of rotatable crusher arms 94 and stationary crusher arms 96. As is conventional, the respective teeth 138 of crusher arms 94 and 96 break up the ice pieces, and the crushed ice is forced downwardly through the stationary crusher arms 96 where it is guided down the side 140 of housing 120 to the chute 16 that conveys it to the user's glass. It may also be preferable that each rotatable crusher arm 94 have two or more teeth 138, and that the teeth 138 be arranged to fall between the teeth 138 of the stationary crusher arms 96.

Figure 5B:
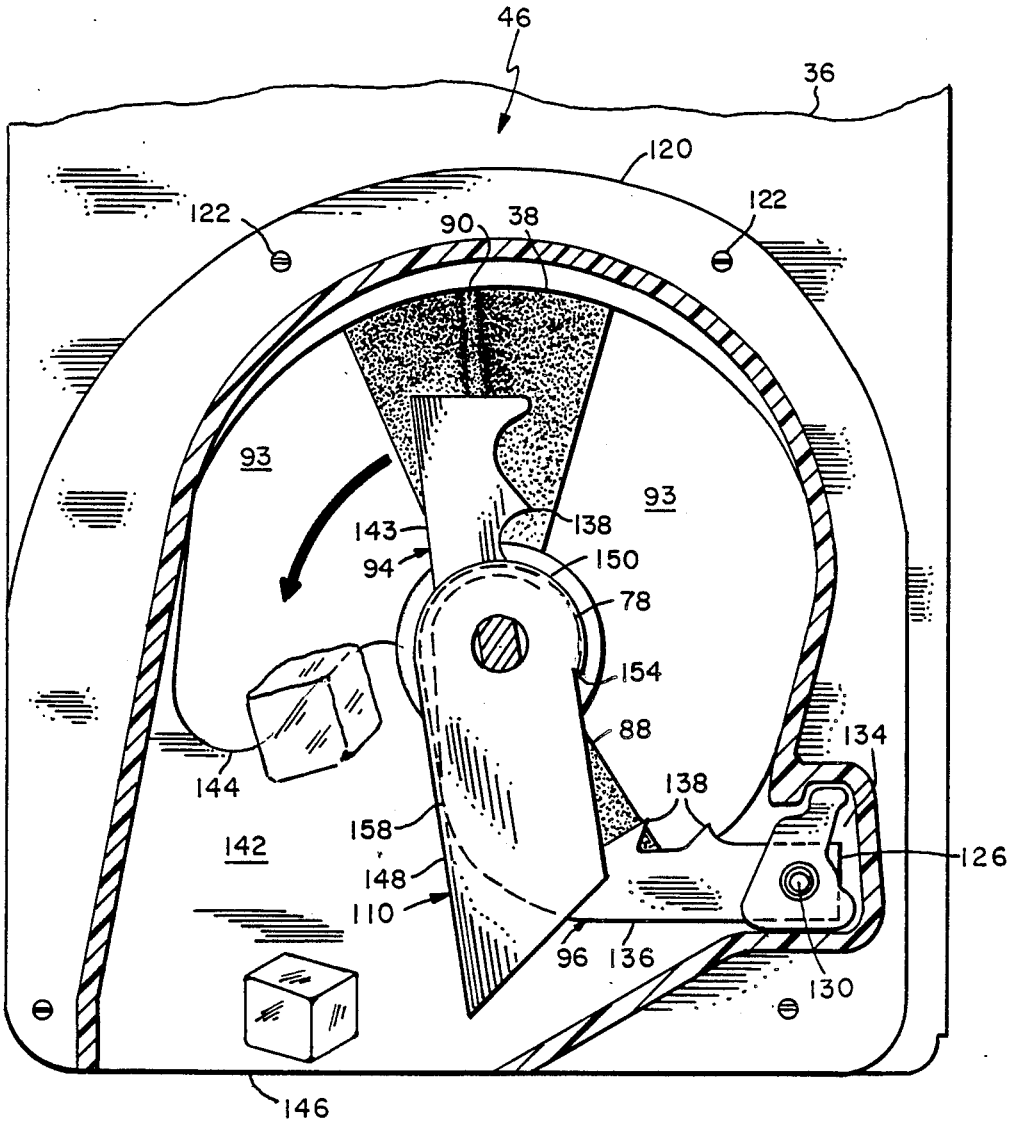

When the user has selected whole ice cubes or ice pieces, reversible motor 50 drive shaft 58 in the counterclockwise direction as shown in FIG. 5B. In this whole ice piece or ice cube mode of operation, ice pieces fed from the left side of discharge opening 38 fall directly down the whole ice piece passageway 142 of housing 120, and ice pieces fed from the right side of discharge opening 38 are carried over the top of shaft 58 by the smooth side 143 of the next rotating set of rotatable crusher arms 94 to the left side such that, in either case, the ice pieces fall down the whole ice piece passageway 142 so that they escape being caught and crushed between the respective rotatable crusher arms 94 and stationary crusher arms 96. In other words, they fall unaltered from the inlet 144 of chamber 124 which is the discharge opening 38 to the outlet 146 of the crusher chamber 124. From the crusher section 46, the whole ice pieces slide intact down chute 16 to the user's glass.

Referring again to FIG. 5A, it was found that in the ice crushing mode of operation when the rotatable crusher arms 94 are moving clockwise, an ice piece would occasionally be fed through the left side of discharge opening 38 and the lower portion of rotatable crusher arm 94 would not be rotated far enough past 6 o'clock to catch the ice piece, and it would fall down through the whole ice piece passageway 142 and be dispensed along with the crushed ice. This was an undesirable occurrence, and barrier arm 110 or baffle provides a rotatable partition to insure that it doesn't happen. More specifically, barrier arm 110 includes an axial flap 148, an axial hood 150 and a perpendicular side plate 152 having a circular hole 153 that is inserted over smaller collar 106. As shown in FIG. 3, the flap 148 and hood 150 overlay a stationary crusher arm 96, and are interleaved between rotatable crusher arms 94. Friction washers 108 and 112 are positioned on both sides of side plate 152, and the axial mounting space for all three parts on the smaller collar 106 is precisely selected so as to provide a friction clutch responsive to the rotation of a rotatable crusher arm 94. More specifically, washers 108 and 112 may be made of polymer composites using either stamping or injection molding, and preferably are peripherally waved so as to be axially resilient. Accordingly, friction washers 108 and 112 function as spring clutch disks so as to cause barrier arm 110 to be frictionally rotatable with rotatable crusher arms 94. When rotatable crusher arms 94 are rotated clockwise as they would be in the ice crushing mode as shown in FIG. 5A, the rotation of crusher arm 94 against friction washer 112 causes it to rotate and also to rotate barrier arm 110 in the clockwise direction until the right edge 154 of hood 150 contacts a stop 156 on stationary crusher arm 96. Such stopping action may occur when the barrier arm 110 is at approximately 45° up from vertical, or between 7 o'clock and 8 o'clock, and the friction by waved friction washers 108 and 112 is large enough so that barrier arm 110 can hold one or more pieces of ice that may fall thereon, but not so large as to prevent or impede slippage of further rotation of rotatable crusher arms 94 with barrier arm 110 in that position. Accordingly, any ice pieces that would otherwise fall through escape passageway 142 during the crushing mode of operation are held on axial flaps 148 of adjacent parallel barrier arms 110 until the next set of rotatable crusher arms 94 rotate up interleaved therebetween and carry the ice piece or pieces over the top of shaft 58 for crushing.

Referring to FIG. 5B, rotatable crusher arms 94 rotate in the counterclockwise direction in the whole ice piece mode as described heretofore, and this causes barrier arms 110 to rotate in the counterclockwise direction until axial flap 148 contacts the vertical edge 158 of stationary crusher arm 96. Accordingly, in the whole ice piece mode of operation, barrier arms 110 are rotated counterclockwise out of the whole ice piece passageway 142 on the left side of shaft 58 so that the whole ice pieces can drop unaltered to the user's glass as described heretofore.

Still referring to FIGS. 5A and 5B, and also to FIG. 2, the size and shape of ice discharge opening 38 was determined by trial and error experiment so as to optimize the feeding of ice pieces to crusher section 124. It was desirable that ice pieces feed at approximately the same rate whether shaft 58 is rotated clockwise or counterclockwise, and that ice pieces feed from both the left and right sides. Further, ice discharge opening 38 is raised on the left side as shown best in FIG. 5A so that when barrier arm 110 is in the raised position, ice pieces are not fed through ice discharge opening 38 against the side of barrier arm 110. In other words, the shape of ice discharge opening 38 protects barrier arm 38 so that ice pieces are not forced axially against it. Before barrier arm 110 was included in the design of crusher section 124, the left side of ice discharge opening 38 was also raised so that a larger percentage of ice pieces would feed on the right side thereby reducing the incidence of whole ice pieces feeding through in the ice crushing mode of operation. In one embodiment, the maximum horizontal dimension of ice discharge opening 38 is 4.5" and the maximum vertical dimension is 3.5".

Also, as shown in FIGS. 5A and 5B, shaft 58 is twisted or keyhole 100 is oriented so that the rotatable crusher arm 94 closest front plate 36 aligns with and rotates with the rib 90 of vane 88. That is, rib 90 aligns with the center line of the first rotatable crusher arm 94 so as to optimize the opening through which ice pieces can feed through ice discharge opening 38 past rotatable crusher arm 94 into crusher section 124. As shown by the phantom portion of rotatable crusher arm 94 on the left side of FIG. 5A, the teeth 138 of rotatable crusher arm 94 extend up above rib 90 and therefore may slightly interfere with the feed of ice pieces into crusher section 124. However, to time the points of teeth 138 with rib 90 would mean that the smooth side 143 would extend further into the opening when the shaft 58 is rotated in the counterclockwise direction in the whole ice cube mode of operation. In other words, the angular orientation of the first rotatable crusher arm 94 with respect to rib 90 splits the difference so as not to unduly interfere with ice feeding in either direction of rotation.

This concludes the description of the preferred embodiment. It is understood that the reading of it by one skilled in the art will bring to mind many alterations and modifications with departing from the spirit and scope of the invention. Accordingly, it is intended that the invention be limited only by the appended claims.

What is claimed is:

1. A selective ice crusher that is fed whole ice pieces and optionally dispenses either crushed ice or whole ice pieces, said ice crusher comprising:

a horizontal shaft;

means for axially rotating said shaft in either direction;

a first stationary ice crusher arm mounted on one side of said shaft;

a second crusher arm mounted to said shaft for rotation with said shaft wherein, when said shaft and said second crusher arm are rotated in one direction, ice pieces fed to said ice crusher are caught and crushed between said first and second crusher arms, and when said shaft and second crusher arm are rotated in the opposite direction, ice pieces fed to said ice crusher fall down a path on the side of said shaft opposite said stationary crusher arm wherein said selective ice crusher dispenses whole ice pieces; and means rotatable with said shaft to a first position in said path when said shaft is rotated in said one direction for preventing whole ice pieces from falling down said path when ice pieces are being crushed, said preventing means being rotatable with said shaft to a second position out of said path when said shaft is rotated in said opposite direction so that ice pieces are free to fall down said path.

2. The ice crusher recited in claim 1 wherein said preventing means comprises a plate having a hole through which said shaft extends.

3. The ice crusher recited in claim 2 wherein said preventing means further comprises an axial flap connected to said plate, said preventing means being stopped at said second position when said preventing means is rotated in said opposite direction by said flap engaging said first stationary crusher arm.

4. The ice crusher recited in claim 2 wherein said preventing means further comprises an axial hood connected to said plate, said preventing means being stopped at said first position when said preventing means is rotated in said one direction by said hood engaging a stop on said first stationary crusher arm.

5. The ice crusher recited in claim 2 wherein said preventing means further comprises friction clutch means for driving said plate in both said one and said opposite directions and for allowing said plate to stop respectively at said first and second position while said shaft continues to rotate in said respective directions.

6. The ice crusher recited in claim 5 wherein said friction clutch means comprises a friction washer positioned on said shaft between said plate and said second crusher arm.

7. The ice crusher recited in claim 6 further comprising a stepped washer having first and second collars, said stepped washer being inserted on said shaft, said first stationary crusher arm having one end inserted on said first collar and said preventing means and said friction washer being inserted on said second collar.

8. The ice crusher recited in claim 7 further comprising a second friction washer positioned on said second collar.

9. The ice crusher recited in claim 6 wherein said friction washer is a waved plastic washer.

10. In an ice dispenser having a reversible motor driving a horizontal shaft wherein, when said shaft is driven in one direction, crusher arms rotating with said shaft crush ice pieces against stationary crusher arms on one side of said shaft in a selectable ice crushing mode of operation and, when said shaft is driven in the opposite direction, whole ice pieces fall down a passageway on the opposite side of said shaft in a selectable whole ice piece mode of operation, means rotatable about said shaft to a first position in said passageway in response to rotation of said shaft in said one direction for preventing whole ice pieces from being dispensed in said ice crushing mode of operation, said preventing means being rotatable about said shaft to a second position out of said passageway in response to rotation of said shaft in said opposite direction for permitting whole ice pieces to be dispensed through said passageway in said whole piece mode of operation.

11. An ice dispenser, comprising:

a selective ice crusher comprising a substantially horizontal shaft having a set of crusher arms secured to said shaft for rotation therewith, said ice crusher further comprising a set of stationary crusher arms on one side of said shaft;

means for feeding ice pieces to said ice crusher;

means for driving said shaft and said set of rotatable crusher arms in one direction to catch and crush said ice pieces fed to said ice crusher between said set of rotatable crusher arms and said set of stationary crusher arms and for selectively driving said shaft and said set of rotatable crusher arms in the opposite direction to cause said ice pieces to fall down a passageway on the opposite side of said shaft and thereby avoid being crushed between said set of rotatable crusher arms and said set of stationary crusher arms; and means for blocking said passageway when said shaft is rotated in said one direction, said blocking means comprising a barrier arm frictionally coupled for rotation on said shaft between a first position in said passageway when said shaft is rotated in said one direction and a second position out of said passageway when said shaft is rotated in the opposite direction.

12. The ice dispenser recited in claim 11 wherein said blocking means further comprises a friction washer inserted on said shaft between said barrier arm and one rotatable crusher arm of said set of rotatable crusher arms for providing a clutch to rotate said barrier arm to said first position when said shaft is rotated in said one direction and thereafter to slip as said shaft continues to be rotated in said one direction.

13. The ice dispenser recited in claim 11 wherein said barrier arm comprises a plate having a hole through which said shaft inserts, said barrier arm further comprising an axial flap and an axial hood connected to said plate.

14. The ice dispenser recited in claim 13 wherein said axial hood engages one of said stationary crusher arms of said set of stationary arms to stop said barrier arm at said first position when said shaft is rotated in said one direction.

15. An ice dispenser, comprising:

a receptacle for storing ice pieces, said receptacle having a front plate with a discharge opening;

a rotatable shaft passing through said receptacle and extending forwardly through said discharge opening;

means for selectively rotating said shaft about its axis in either direction;

means positioned in said receptacle and rotatably connected to said shaft for dispensing ice pieces through said discharge opening when said shaft is rotated in one direction and also when shaft is rotated in the opposite direction;

means positioned in front of said plate and rotatably coupled to said shaft for selectively crushing ice pieces dispensed through said discharge opening when said shaft is rotated in said one direction, said selective crushing means being inoperative for crushing ice pieces when said shaft is rotated in said opposite direction, said selective crushing means comprising a set of rotatable crusher arms mounted to said shaft for rotation therewith and a set of stationary crusher arms mounted on one side of said shaft; and means rotatable about said shaft to a first position on the side of said shaft opposite said stationary crusher arms in response to rotation of said shaft in said one direction for preventing whole ice pieces from being dispensed when ice pieces are being selectively crushed, said preventing means being rotatable about said shaft to a second position away from said opposite side of said shaft in response to rotation of said shaft in said opposite direction to permit whole ice pieces to be dispensed down said opposite side of said shaft.

16. The method of preventing whole ice cubes from being dispensed during an ice crushing mode of operation of a selective ice crusher having a reversible motor driven shaft with a rotatable crusher arm connected thereto and a stationary crusher arm on one side of the shaft wherein, in the ice crushing mode, ice pieces are crushed between the rotatable crusher arm and the stationary crusher arm, and in the whole ice piece mode, ice pieces are dispensed down a path on the side of said shaft opposite the stationary crusher arm, comprising the steps of:

rotating an ice barrier frictionally mounted on said shaft to a first position in said path in response to said shaft rotating in said one direction; and rotating said ice barrier to a second position out of said path in response to said shaft rotating in the opposite direction.

* * * * *